US009746149B2

(12) United States Patent
Toyoyama et al.

(10) Patent No.: US 9,746,149 B2
(45) Date of Patent: Aug. 29, 2017

(54) VEHICLE LIGHTING UNIT HAVING BULB FIXATION STRUCTURE

(71) Applicant: Stanley Electric Co., Ltd., Tokyo (JP)

(72) Inventors: Hideki Toyoyama, Tokyo (JP); Yasuhiro Kobayashi, Tokyo (JP)

(73) Assignee: STANLEY ELECTRIC CO., LTD, Tokyo (JP)

( * ) Notice: Subject to any disclaimer, the term of this patent is extended or adjusted under 35 U.S.C. 154(b) by 79 days.

(21) Appl. No.: 14/833,628

(22) Filed: Aug. 24, 2015

(65) Prior Publication Data

US 2016/0053956 A1 Feb. 25, 2016

(30) Foreign Application Priority Data

Aug. 22, 2014 (JP) ..... 2014-169494

(51) Int. Cl.
*F21S 8/10* (2006.01)

(52) U.S. Cl.
CPC ..... *F21S 48/1113* (2013.01); *F21S 48/1168* (2013.01); *F21S 48/1104* (2013.01)

(58) Field of Classification Search
CPC F21S 48/1113; F21S 48/1168; F21S 48/1104; F21S 48/1109; F21S 48/1118; F21S 48/1122
See application file for complete search history.

(56) References Cited

U.S. PATENT DOCUMENTS 4,760,506 A * 7/1988 Mochizuki ..... H01R 33/00 362/267
4,829,408 A * 5/1989 Haydu ..... F21S 48/1113 362/306
5,893,632 A * 4/1999 Kusagaya ..... F21S 48/1113 362/438
6,698,913 B2 * 3/2004 Yamamoto ..... B60Q 1/007 362/345
9,108,564 B2 * 8/2015 Petker ..... F21S 48/1113
2013/0272010 A1 * 10/2013 Kawamura ..... F21S 48/00 362/519
2014/0313759 A1 * 10/2014 Petker ..... F21S 48/1113 362/519

FOREIGN PATENT DOCUMENTS

JP 10-31901 A 2/1998
JP 2978795 B2 9/1999

* cited by examiner

*Primary Examiner* — Alan Cariaso
(74) *Attorney, Agent, or Firm* — Kenealy Vaidya LLP

(57) ABSTRACT

A vehicle lighting unit with a bulb fixation structure is configured such that a metal supporter spring is attached to an opening end face of a holder projected from a peripheral edge of a bulb attachment hole opened in a reflector, engagement claws provided to the bulb pass through respective claw escape holes formed in the supporter spring so that the bulb is incorporated within the holder, and then the bulb is rotated. Thereby, the bulb is fixed to the main body with a type of a bayonet scheme in which the engagement claws of the bulb are interposed in between and held by the engagement spring of the supporter spring and an opening end face of the bulb attachment hole. The supporter spring is attached to the opening end face of the holder by countersunk screws at at least three locations in a circumferential direction of the supporter spring.

5 Claims, 5 Drawing Sheets

VEHICLE LIGHTING UNIT HAVING BULB FIXATION STRUCTURE

This application claims the priority benefit under 35 U.S.C. §119 of Japanese Patent Application No. 2014-169494 filed on Aug. 22, 2014, which is hereby incorporated in its entirety by reference.

TECHNICAL FIELD

The presently disclosed subject matter relates to a vehicle lighting unit having a bulb fixation structure for fixing a bulb to a reflector or the like member with a bayonet mechanism.

BACKGROUND ART

Conventional vehicle lighting units have employed bulbs as a light source and examples of such bulbs may include HB3 type, HB4 type, HIR2 type, etc. Such a bulb can be detachably fixed to the main body of a vehicle lighting unit, such as to a reflector, a housing, or the like with a bayonet mechanism. Examples of this type of vehicle lighting unit may include those described in Japanese Patent Application Laid-Open No. Hei. 10-031901 and Japanese Patent No. 2978795.

A description will now be given of one example of a fixation structure for fixing a bulb by means of a bayonet scheme (bayonet mechanism) with reference to FIG. 1.

FIG. 1 is an exploded perspective view illustrating an example of a conventional bulb fixation structure of a vehicle lighting unit. In the illustrated example, the vehicle lighting unit has a main body, which is a resin-made reflector 1. The reflector 1 has an opening serving as a bulb attachment hole 2 in a circle shape on its rear surface. The vehicle lighting unit has a cylindrical holder 3 that is integrally formed with and projected around the peripheral edge of the bulb attachment hole 2 on the rear surface of the reflector 1. The holder 3 has an opening end face 3*c*, to which a ring-shaped supporter spring 4 formed of a thin metal plate, such as SUS with a thickness of 0.6 mm, is attached with two screws 5. The supporter spring 4 has an engagement claw 4*b* at one location of the inner periphery thereof by cutting and rising part of the supporter spring 4. Further, the holder 3 of the reflector 1 has an engagement groove 3*b* formed at one location of the inner periphery thereof. The engagement claw 4*b* can engage with the engagement groove 3*b*.

Furthermore, the supporter spring 4 has three cut-out arc-shaped claw escape holes 4A at three locations of the inner periphery thereof in the circumferential direction. The supporter spring 4 further has three engagement springs 4*c* adjacent to the respective claw escape holes 4A in the circumferential direction by cutting and bending a part of the plate-shaped supporter spring 4 toward the holder 3 as illustrated in FIG. 1.

On the other hand, a disc-shaped flange 8 is provided to the outer periphery of the base portion of the bulb 6 (where a socket 7 is connected) so as to be perpendicularly erected therefrom. The flange 8 has three arc-shaped engagement claws 8A at three locations of the periphery thereof so as to project radially outward. The shape of the engagement claw 8A coincides with the claw escape hole 4A of the supporter ring 4.

In the conventional bulb fixation structure of the vehicle lighting unit, when the bulb 6 is fixed to the reflector 1, first, the tip end of the bulb 6 is inserted into the bulb attachment hole 2 of the reflector 1 and the three engagement claws 8A of the flange 8 of the bulb 6 are allowed to be matched to the three claw escape holes 4A of the supporter spring 4 and pass therethrough, thereby incorporating these three engagement claws 8A inside the holder 3 of the reflector 1. Then, the flange 8 of the bulb 6 is urged against an opening end face 3*d* of the bulb attachment hole 2 opened within the holder 3 of the reflector 1. After that, the bulb 6 in this state is rotated by a predetermined angle in a clockwise direction in FIG. 1 around its axial center. By doing so, the three engagement claws 8A of the flange 8 are engaged with the respective engagement springs 4*c* of the supporter spring 4. In this manner, the bulb 6 is fixed to the reflector 1 by means of the bayonet mechanism. Specifically, this is because the flange 8 of the bulb 6 is interposed in between and held by the opening end face 3*d* of the bulb attachment hole 2 and the engagement springs 4*c* of the supporter spring 4.

In the conventional bulb fixation structure as illustrated in FIG. 1, during the fixation operation in which the three engagement claws 8A are allowed to be matched to the three claw escape holes of the supporter spring 4 and pass therethrough and then the bulb 6 is rotated by a predetermined angle around its axial center, since the supporter spring 4 is made of a thin metal plate such as a SUS with a thickness of 0.6 mm and is attached by screws 5 only at two locations, the following problems arise. Incidentally, when the supporter spring 4 is fixed with the use of normal screws 5, the supporter spring 4 should be fixed at two locations with two screws 5 otherwise the screws 5 and the bulb 6 interfere with each other.

The problem is such that the supporter spring 4 tends to float when it is fixed only by two screws 5. In this situation, the three engagement claws 8A cannot pass through the three claw escape holes 4A of the supporter spring 4 simultaneously. In this case, for example, part of (one of, for example) the engagement claws 8A may stride over the claw escape hole 4A of the supporter spring 4 and ride on the supporter spring 4 itself. This results in insufficient fixation of the bulb 6 to the reflector 1 due to wrong assembling.

SUMMARY

The presently disclosed subject matter was devised in view of these and other problems and features in association with the conventional art. According to an aspect of the presently disclosed subject matter, a fixation structure for a vehicle lighting unit can fix a bulb with reliability.

According to a first aspect of the presently disclosed subject matter, a vehicle lighting unit having a bulb fixation structure can include: a main body, such as a reflector, having a bulb attachment hole formed therein and an opening end face, and a holder that is integrally formed with the main body and projected around a peripheral edge of the bulb attachment hole and has an opening end face; a supporter spring that is made of a metal plate and is attached to the opening end face of the holder, the supporter spring having a plurality of claw escape holes by cutting part of the supporting spring and a plurality of engagement springs formed adjacent to the respective claw escape holes; and a bulb having a plurality of engagement claws to be allowed to pass through the claw escape holes of the supporter spring so that part of the bulb is incorporated within the holder, wherein the bulb is fixed to the main body with a type of a bayonet scheme in which the passed bulb is rotated around an axial center thereof, so that the engagement claws of the bulb are interposed in between and held by the engagement springs of the supporter spring and the opening end face of the bulb attachment hole, and the supporter spring is attached to the opening end face of the holder by countersunk screws at at least three locations in a circumferential direction of the supporter spring.

According to a second aspect of the presently disclosed subject matter, the vehicle lighting unit having a bulb fixation structure according to the first aspect can be configured such that the supporter spring can be formed with tapered cylindrical screw holes at locations corresponding to the at least three locations for the countersunk screws so that the countersunk screws can be inserted thereinto.

According to a third aspect of the presently disclosed subject matter, the vehicle lighting unit having a bulb fixation structure according to the first or second aspect can be configured such that the holder of the main body can have a stopper rib projected from an inner wall thereof so as to prevent the bulb being in contact with the stopper rib from rotating.

According to a fourth aspect of the presently disclosed subject matter, the vehicle lighting unit having a bulb fixation structure according to any of the first to third aspects can be configured such that a projection for preventing wrong assembling can be formed at one circumferential end of each of the claw escape holes of the supporter spring.

According to a fifth aspect of the presently disclosed subject matter, the vehicle lighting unit having a bulb fixation structure according to the fourth aspect can be configured such that the engagement springs can be formed on a side of the holder and the projections can be formed on a side opposite to the side of the holder with respect to the supporter spring. In this case, the engagement springs and the projections can be formed continuously on the holder side and on the opposite side thereto, respectively.

In the first aspect of the presently disclosed subject matter, the use of the countersunk screws for attachment of the supporter spring can prevent the interference between the screws and the bulb, thereby eliminating the limit of the number of the usable screws. Therefore, the supporter spring can be fixed at three or more locations with the three or more countersunk screws in the circumferential direction of the supporter spring to the holder of the main body reliably, meaning that the floating of the supporter spring can be reliably prevented. The reliable fixation of the supporter spring can ensure the simultaneous passing of the plurality of engagement claws of the bulb through the plurality of claw escape holes of the supporter spring as well as the engagement of the bulb with the engagement springs of the supporter spring, to thereby always reliably fix the bulb to the main body of the lighting unit without wrong assembling.

In the second aspect of the presently disclosed subject matter, even with the use of the thin supporter spring, the tapered cylindrical screw holes are formed in the supporter spring at three or more locations in the circumferential direction, and therefore, the tightening of the countersunk screws into the tapered cylindrical screw holes can cause the supporter spring to be reliably attached to the holder of the main body with a required strength.

In the third aspect of the presently disclosed subject matter, the assembled bulb to the main body can be in contact with the stopper rib projected from the main body to be prevented from rotating. This can prevent the loosening of the bulb.

In the fourth aspect of the presently disclosed subject matter, the supporter spring can have the projections projected from one circumferential ends of the respective claw escape holes of the supporter spring. The circumferential end herein means the side where the engagement claw starts to engage with the lower surface of the supporter spring when the bulb is rotating. Therefore, even if all the engagement claws do not pass through the corresponding claw escape holes simultaneously so that part of the engagement claw does not pass through the claw escape hole and tries to stride over the supporter spring, the projection for preventing wrong assembling can prevent the engagement claw from striding over the supporter ring. Therefore, all the engagement claws of the bulb can simultaneously pass through the claw escape holes of the supporter spring to reliably engage with the engagement springs of the supporter spring, to thereby always reliably fix the bulb to the main body of the lighting unit without wrong assembling.

In the fifth aspect of the presently disclosed subject matter, the engagement springs can be formed on a side of the holder and the projections can be formed on a side opposite to the side of the holder with respect to the supporter spring. In this case, the engagement springs and the projections can be formed continuously on the holder side and on the opposite side thereto, respectively. This configuration can facilitate the engagement of the engagement claws of the bulb with the engagement springs by the projections (on the side opposite to the holder side) that can prevent the engagement claws from striding over the supporter spring on that side and guide the engagement claws at their rear surfaces toward the engagement springs on the holder side.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to a vehicle lighting unit of the presently disclosed subject matter with reference to the accompanying drawings in accordance with exemplary embodiments.

Figure 1:
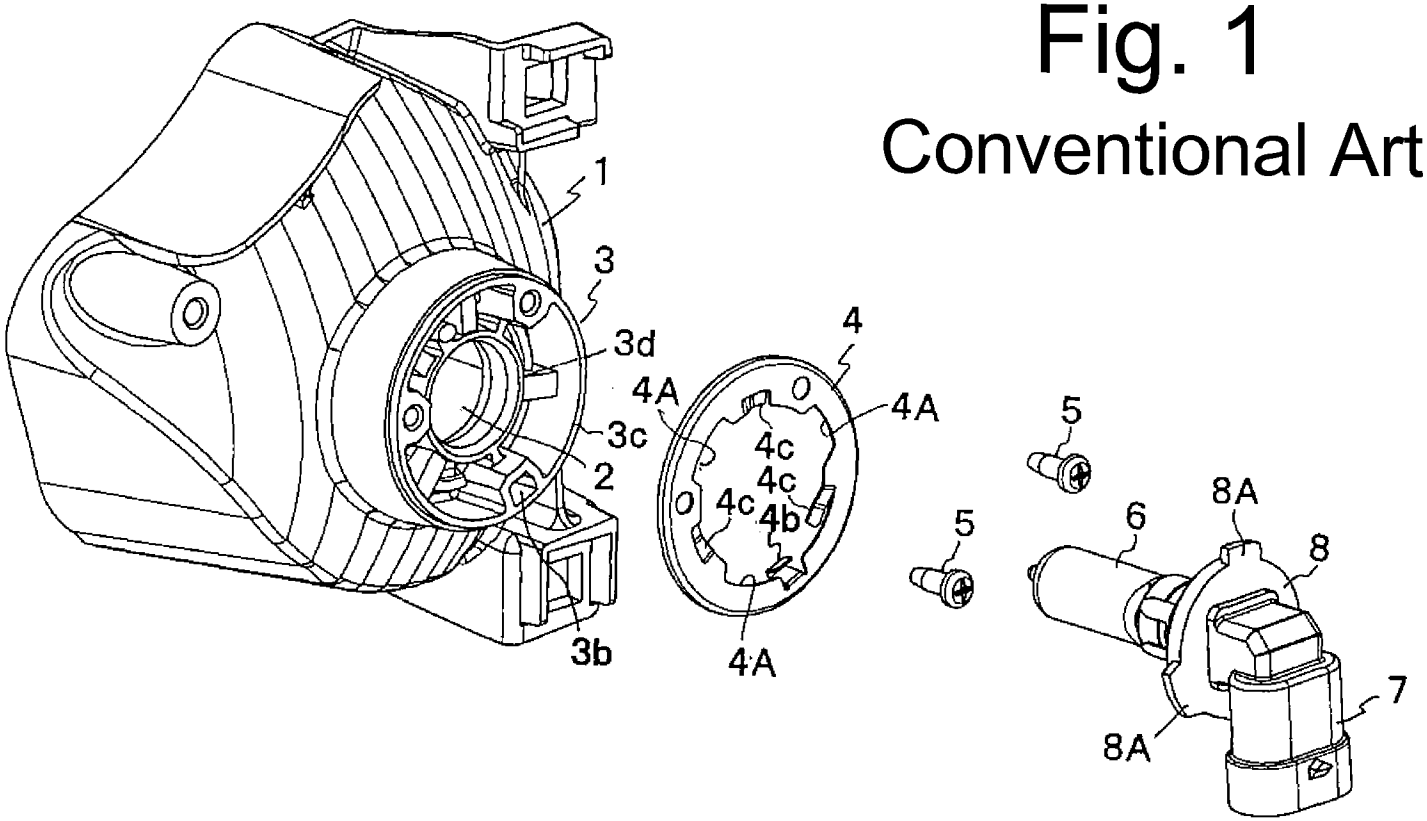
Fig. 1 Conventional Art
FIG. 1 is an exploded perspective view of a conventional bulb fixation structure for fixing a bulb with a bayonet mechanism.
Figure 2:
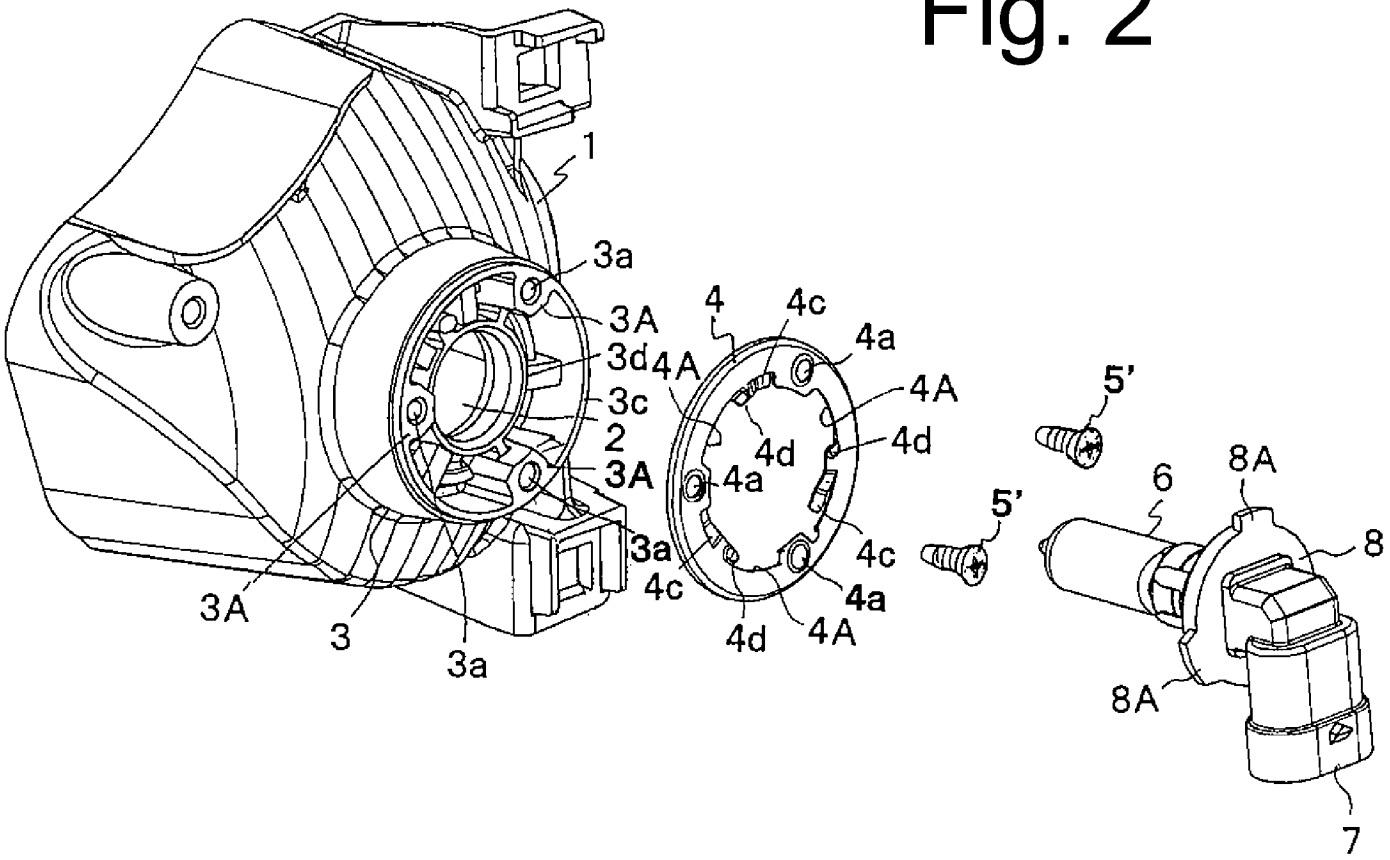
FIG. 2 is an exploded perspective view of a vehicle lighting unit having a bulb fixation structure for fixing a bulb, made in accordance with principles of the presently disclosed subject matter.
Figure 3:
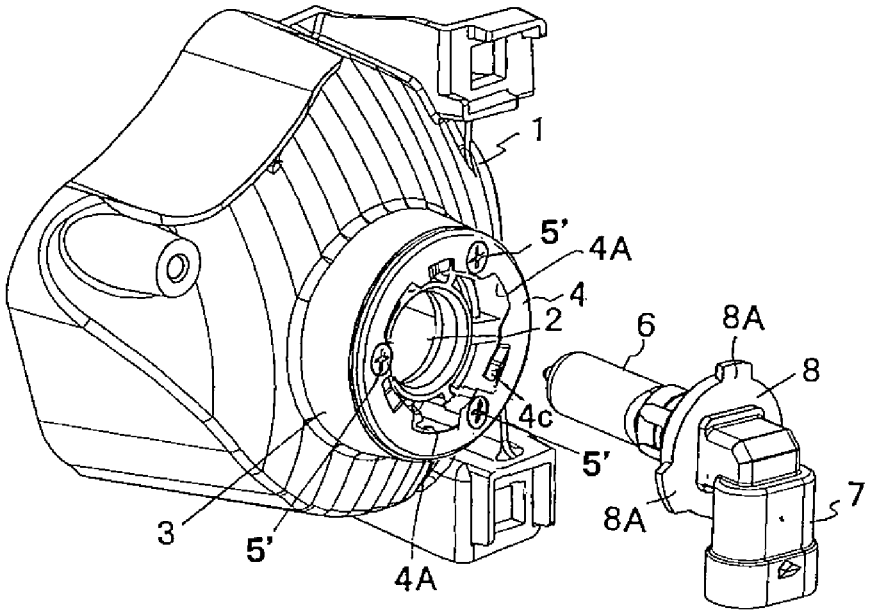
FIG. 3 is a perspective view illustrating a state before the bulb is fixed to the main body of the vehicle lighting unit with the bulb fixation structure made in accordance with the principles of the presently disclosed subject matter.
Figure 4:
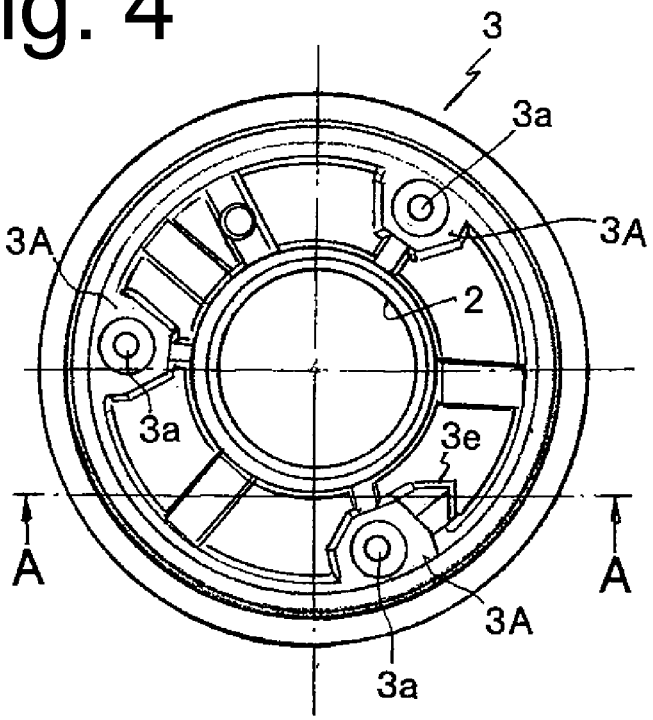
FIG. 4 is a front view of a holder of a reflector that constitutes part of the bulb fixation structure of the vehicle lighting unit made in accordance with the principles of the presently disclosed subject matter.
Figure 5:
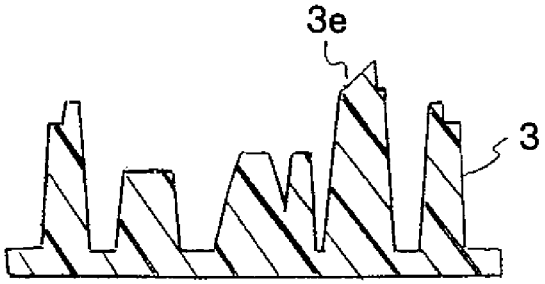
FIG. 5 is a cross sectional view taken along line A-A in FIG. 4.
Figure 6:
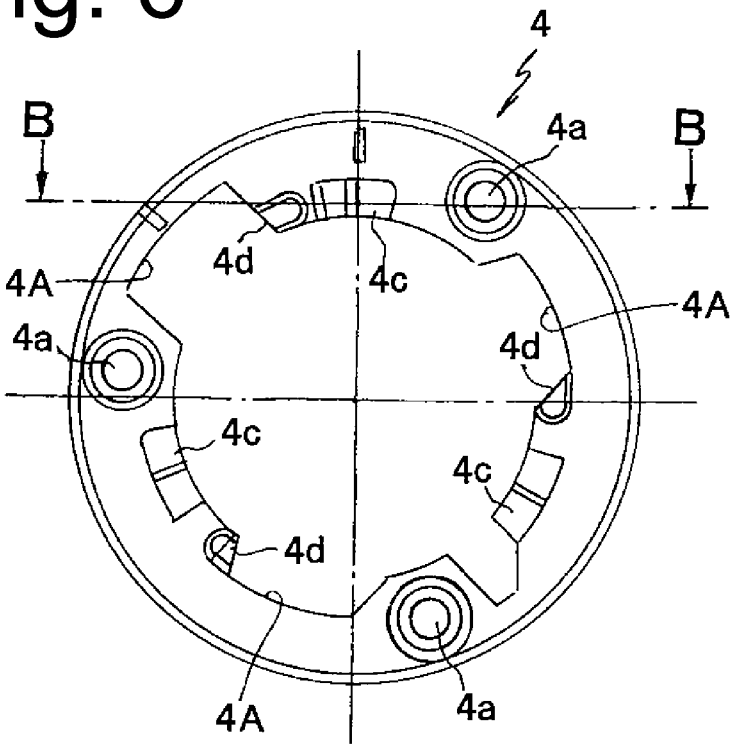
FIG. 6 is a front view of a supporter spring that constitutes part of the bulb fixation structure of the vehicle lighting unit made in accordance with the principles of the presently disclosed subject matter.
Figure 7:
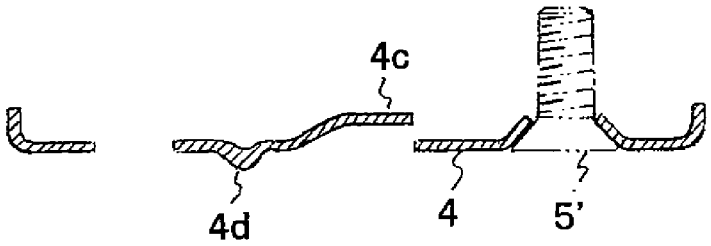
FIG. 7 is a cross sectional view taken along line B-B in FIG. 6.

FIG. 2 is an exploded perspective view of a vehicle lighting unit having a bulb fixation structure for fixing a bulb, made in accordance with the principles of the presently disclosed subject matter. FIG. 3 is a perspective view illustrating a state before the bulb is fixed to the main body of the vehicle lighting unit with the bulb fixation structure. FIG. 4 is a front view of a holder of a reflector, and FIG. 5 is a cross sectional view taken along line A-A in FIG. 4. FIG. 6 is a front view of a supporter spring, and FIG. 7 is a cross sectional view taken along line B-B in FIG. 6. In these drawings, the same or similar components as or to those illustrated in FIG. 1 are denoted by the same reference numerals as those in FIG. 1.

As illustrated in FIG. 2, the vehicle lighting unit can have a main body, which can be a resin-made reflector 1. The reflector 1 can have an opening serving as a bulb attachment hole 2 in a circle shape on its rear surface. The vehicle lighting unit can have a cylindrical holder 3 that is integrally and concentrically formed with and projected around the peripheral edge of the bulb attachment hole 2 on the rear surface of the reflector 1. As illustrated in FIG. 4, bosses 3A can be integrally formed with the holder 3 on its inner periphery at three locations at equiangular pitches (120° pitch), and each of the bosses 3A can have a screw hole 3*a* formed therethrough. Furthermore, as illustrated in FIGS. 4 and 5, a stopper rib 3*e* can be formed integrally with the holder 3 so as to be projected inside the holder 3 and beside one of the bosses 3A. The stopper rib 3*e* can be configured such that the bulb 6 after incorporated into the reflector 1 can be in contact with the stopper rig 3*e* to prevent the bulb 6 from rotating.

The holder 3 projected from the rear surface of the reflector 1 can have an opening end face 3*c* in a ring shape, to which a ring-shaped supporter spring 4 formed of a thin metal plate, such as SUS with a thickness of 0.6 mm, can be attached with three or more (in the illustrated example, three) countersunk screws 5' as illustrated in FIG. 3.

Specifically, the supporter spring 4 can have tapered cylindrical screw holes 4*a* at three or more (in the illustrated example, three) locations in the circumferential direction at equiangular pitches (120° pitch), formed by burring process or the like. The countersunk screws 5' can be inserted to the respective screw holes 4*a* and then screwed to the respective screw holes 3*a* formed in the respective bosses 3A of the holder 3, thereby attaching the supporter spring 4 to the opening end face 3*c* of the holder 3 of the reflector 1, as illustrated in FIG. 3. Therefore, the use of the countersunk screws 5' for attaching of the supporter spring 4 can prevent the heads of the screws from projecting from the plane including the surface of the supporter spring 4.

Furthermore, as illustrated in FIGS. 2 and 6, the supporter spring 4 can have three cut-out arc-shaped claw escape holes 4A at three locations of the inner periphery thereof in the circumferential direction at equiangular pitches (120° pitch). The supporter spring 4 can further have three engagement springs 4*c* (see FIG. 7) adjacent to the respective claw escape holes 4A in the circumferential direction by cutting and bending a part of the plate-shaped supporter spring 4 toward the holder 3.

In the present exemplary embodiment, as illustrated in FIGS. 6 and 7, a bead-shaped projection 4*d* can be integrally formed at one circumferential end of each of the claw escape holes 4A of the supporter spring 4. The projection 4*d* can serve to prevent the wrong assembling. As illustrated in FIG. 7, the engagement spring 4*c* and the projection 4*d* can be formed continuously but the engagement springs 4*c* can be formed on the side of the holder while the projections 4*d* can be formed on the side opposite to the holder side. This configuration can facilitate the engagement of the engagement claws 8A of the bulb 6 with the engagement springs 4*c* by the projections 4*d* (on the side opposite to the holder side) that can prevent the engagement claws 8A from striding over the supporter spring 4 on that side and guide the engagement claws 8A at their rear surfaces toward the engagement springs 4*c* on the holder side.

On the other hand, a disc-shaped flange 8 can be provided to the outer periphery of the base portion of the bulb 6 (where a socket 7 can be connected) so as to be perpendicularly erected therefrom as illustrated in FIGS. 2 and 3. The flange 8 can have three arc-shaped engagement claws 8A at three locations of the periphery thereof so as to project radially outward. FIGS. 2 and 3 illustrate two of them. The shape of the engagement claw 8A can coincide with the claw escape hole 4A of the supporter ring 4 so as to be able to be inserted therethrough.

In the bulb fixation structure of the vehicle lighting unit, when the bulb 6 is fixed to the reflector 1, first, the tip end of the bulb 6 can be inserted into the bulb attachment hole 2 of the reflector 1 and the three engagement claws 8A of the flange 8 of the bulb 6 can be allowed to be matched to the three claw escape holes 4A of the supporter spring 4 and pass therethrough, thereby incorporating these three engagement claws 8A inside the holder 3 of the reflector 1. Then, the flange 8 of the bulb 6 can be urged against an opening end face 3*d* of the bulb attachment hole 2 opened within the holder 3 of the reflector 1 as illustrated in FIG. 2. After that, the bulb 6 in this state can be rotated by a predetermined angle in a clockwise direction in FIG. 3 around its axial center. By doing so, the three engagement claws 8A of the flange 8 can be engaged with the respective engagement springs 4*c* of the supporter spring 4. In this manner, the flange 8 of the bulb 6 can be interposed in between and held by the opening end face 3*d* of the bulb attachment hole 2 and the engagement springs 4*c* of the supporter spring 4, whereby fixing of the bulb 6 to the reflector 1 can be achieved by means of the bayonet mechanism.

When the bulb 6 having been fixed in the above-described manner is removed from the reflector 1 for replacement, etc., the bulb 6 can be rotated around its axial center in a reverse direction when fixing, i.e., in a counterclockwise direction, by the predetermined angle, to match the engagement claws 8A to the respective claw escape holes 4A of the supporter spring 4. In this state, the bulb 6 can be withdrawn in a direction opposite to the insertion direction, to thereby be easily removed from the reflector 1.

As described above, the bulb 6 can be fixed to the reflector 1 with the bayonet mechanism with the use of the countersunk screws 5' for attaching the supporter spring 4 in the fixation structure made in accordance with the principles of the presently disclosed subject matter. As a result, the countersunk screws 5' and the bulb 6 can be prevented from interfering with each other, and further there can be no limit for the number of the countersunk screws 5' used. The increased number of the countersunk screws 5' provided at three or more location in the circumferential direction of the supporter spring 4 can reliably fix the supporter spring 4 to the holder 3 of the reflector 1 and prevent the supporter spring 4 from floating due to the fixation failure. Therefore, the reliable fixation of the supporter spring 4 can ensure the simultaneous passing of the plurality of engagement claws 8A of the bulb 6 through the plurality of claw escape holes 4A of the supporter spring 4 as well as the engagement of the engagement claws 8A of the bulb 6 with the engagement springs 4*c* of the supporter spring 4, to thereby always reliably fix the bulb 6 to the reflector 1 without wrong assembling.

Furthermore, as illustrated in the present exemplary embodiment, even with the use of the thin supporter spring 4, the tapered cylindrical screw holes 4*a* can be formed in the supporter spring 4 at three locations in the circumferential direction, and therefore, the tightening of the countersunk screws 5' into the tapered cylindrical screw holes 4*a* can cause the supporter spring 4 to be reliably attached to the holder 3 of the reflector 1 with a required strength.

Furthermore, the assembled bulb 6 to the reflector 1 can be in contact with the stopper rib 3*e* projected from the holder 3 of the reflector 1 to be prevented from rotating. This can prevent the loosening of the bulb 6.

Furthermore, in the present exemplary embodiment, the supporter spring 4 can have the projections 4*d* projected from one circumferential ends of the respective claw escape holes 4A of the supporter spring 4. The circumferential end herein means the side where the engagement claw 8A starts to engage with the lower surface of the supporter spring 4 when the bulb 6 is rotating. Therefore, even if all the engagement claws 8A do not pass through the corresponding claw escape holes 4A simultaneously so that part of the engagement claw 8A does not pass through the claw escape hole 4A and tries to stride over the supporter spring 4, the projection 4*d* for preventing wrong assembling can prevent the engagement claw 8A from striding over the supporter ring 4. Therefore, all the engagement claws 8A of the bulb 6 can simultaneously pass through the claw escape holes 4A of the supporter spring 4 to reliably engage with the engagement springs 4*c* of the supporter spring 4, to thereby always reliably fix the bulb 6 to the reflector 1 without wrong assembling.

Furthermore, the engagement springs 4*c* can be formed on the side of the holder 3 (side closer to the holder 3) and the projections 4*d* can be formed on a side opposite to the side closer to the holder 3 with respect to the supporter spring 4. The engagement springs 4*c* and the projections 4*d* can be formed continuously on the holder side and on the opposite side thereto, respectively. This configuration can facilitate the engagement of the engagement claws 8A of the bulb 6 with the engagement springs 4*c* by the projections 4*d* (on the side opposite to the holder side) that can prevent the engagement claws 8A from striding over the supporter spring 4*c* on that side and guide the engagement claws 8A at their rear surfaces toward the engagement springs 4*c* on the holder side.

In the above exemplary embodiment, the bulb 6 is fixed to the reflector 1 with the fixation structure, but the presently disclosed subject matter can be applied to a fixation structure for fixing a bulb 6 to a housing serving as a main body.

The number of the used countersunk screws in the circumferential direction of the supporter spring is three in the illustrated exemplary embodiment, but the number may be four or more locations.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting unit having a bulb fixation structure, comprising:

a main body having a bulb attachment hole formed therein and an opening end face, and a holder that is integrally formed with the main body and projected around a peripheral edge of the bulb attachment hole and has an opening end face;

a supporter spring that is made of a metal plate and is attached to the opening end face of the holder, the supporter spring having a plurality of claw escape holes by cutting part of the supporting spring and a plurality of engagement springs formed adjacent to the respective claw escape holes; and a bulb having a plurality of engagement claws to be allowed to pass through the claw escape holes of the supporter spring so that part of the bulb is incorporated within the holder, wherein the bulb is fixed to the main body with a type of a bayonet scheme in which the passed bulb is rotated around an axial center thereof, so that the engagement claws of the bulb are interposed in between and held by the engagement springs of the supporter spring and the opening end face of the bulb attachment hole, the supporter spring is attached to the opening end face of the holder by countersunk screws at at least three locations in a circumferential direction of the supporter spring, the supporter spring is formed with tapered cylindrical screw holes at locations corresponding to the at least three locations for the countersunk screws so that the countersunk screws are inserted thereinto a projection for preventing wrong assembling is formed at one circumferential end of each of the claw escape holes of the supporter spring the engagement springs are formed on a side of the holder and the projections are formed on a side opposite to the side of the holder with respect to the supporter spring, the projection and the engagement spring are continuously and integrally formed to be smoothly transitioned to each other, and the claw escape hole, the projection, the engagement spring, and the screw hole are arranged in this order in the circumferential direction of the supporter spring.

2. The vehicle lighting unit having a bulb fixation structure according to claim 1, wherein the holder of the main body has a stopper rib projected from an inner wall thereof so as to prevent the bulb being in contact with the stopper rib from rotating.

3. The vehicle lighting unit having a bulb fixation structure according to claim 1, wherein the supporter spring is made of a SUS.

4. The vehicle lighting unit having a bulb fixation structure according to claim 1, wherein the countersink screws each have a head not projecting from the supporter spring.

5. The vehicle lighting unit having a bulb fixation structure according to claim 1, wherein the engagement claws of the bulb after inserted into the claw escape holes are rotated to move below the projections and then be held by lower surfaces of the engagement springs that are smoothly and continuously formed with the respective projections.

* * * * *